United States Patent [19]

Doss

[11] Patent Number: 4,471,674

[45] Date of Patent: Sep. 18, 1984

[54] SPINNING TOOL FOR PIPE, ROD AND CYLINDER ROTATION

[75] Inventor: Hubert M. Doss, Magnolia, Ark.

[73] Assignees: Judy Doss; Charles E. Doss; Fred W. Edwards, Sr., all of Magnolia, Ark.

[21] Appl. No.: 432,126

[22] Filed: Sep. 30, 1982

[51] Int. Cl.[3] ..... B25B 17/00

[52] U.S. Cl. ..... 81/57.17

[58] Field of Search ..... 81/57.17, 57.39

[56] References Cited

U.S. PATENT DOCUMENTS

| | | | |
|---|---|---|---|
| 3,799,010 | 3/1974 | Guier | 81/57.17 |
| 3,906,820 | 9/1975 | Hauk | 81/57.17 |
| 4,079,640 | 3/1978 | Golden | 81/57.17 |
| 4,212,212 | 7/1980 | Chandler et al. | 81/57.17 |
| 4,324,157 | 4/1982 | Soutsos | 81/57.17 |
| 4,407,175 | 10/1983 | Graham | 81/57.39 |

*Primary Examiner*—James L. Jones, Jr.
*Attorney, Agent, or Firm*—Harvey B. Jacobson

[57] ABSTRACT

A main body is provided including a first side moveable laterally toward and away from an elongated member to be turned. The first side includes a pair of outwardly projecting arms whose base ends are pivotally supported from the body for swinging movement of the outer free ends of the arms toward and away from each other and the free arm ends include idle rollers journalled therefrom. A drive roller is journalled from the body inwardly of the first side thereof and elongated flexible drive member structure is trained about the drive and idle rollers. The reach of the drive member structure extending between the sides of the idle rollers remote from the drive roller is inwardly deflectable between the idle rollers when the free ends of the arms are swung apart by engagement of the elongated member to be turned with the drive member structure upon movement of the body toward the elongated member and the inwardly deflected reach of the drive member structure is tensioned about the elongated member when the free ends of the arms are swung toward each other to position the idle rollers on the side of the elongated member remote from the drive roller.

7 Claims, 7 Drawing Figures

SPINNING TOOL FOR PIPE, ROD AND CYLINDER ROTATION

BACKGROUND OF THE INVENTION

Well drilling rigs are conventionally provided with tongs for finally tightening and initially loosening the threaded connections between adjacent pipe sections. In addition, large well drilling rigs use elongated chain sections wrapped around pipe sections to be initially threaded to adjacent pipe sections or to be unthreaded from adjacent pipe sections after having been initially loosened and these elongated chain sections are dangerous to use as well as tiring for the workman operating the chain sections. In addition, these chain sections are wrapped tightly about the pipe sections to be turned and often scar the external surfaces of those pipe sections.

Accordingly, a need exists for an improved form of pipe section turning which may be readily engaged with a pipe section to be turned and thereafter actuated to turn the pipe section in a safe and effective manner.

Examples of previously known forms of pipe turning structures including some of the general structural and operational features of the instant invention are disclosed in U.S. Pat. Nos. 2,746,329, 2,862,690, 3,373,638, 3,786,698, 3,799,010, and 4,212,212.

BRIEF DESCRIPTION OF THE INVENTION

The pipe turning of spinning tool of the instant invention includes a pair of outwardly projecting arms having idle rollers journalled from the free ends thereof and the arms are pivotally supported from the body of the tool for swinging movement of the free ends of the arms toward away from each other. The body of the tool journals a drive wheel and an elongated flexible drive member is trained about the drive wheel and the idle rollers and the reach of the drive member extending between the sides of the idle roller remote from the drive wheel is inwardly deflected by the pipe or pipe section engaged by the tool and displaced inwardly between the idle rollers by the pipe section until the free ends of the arms may be swung toward each other and the drive member is tensioned. Thereafter, the drive wheel is turned in order to cause the drive member to move about the idle rollers and the drive member and also the pipe section deflecting the reach of the drive member extending between the idle rollers. In this manner, rotational torque is applied to the pipe section and the latter may be turned as desired.

The tool may be mounted on a drilling rig tongs for use in lieu of or in conjunction with the tongs and may be mounted upon the tongs for shifting between operative and inoperative positions. Further, the turning tool also may be used in other environments wherein it is desired to rotate an elongated generally cylindrical member.

The main object of this invention is to provide a pipe turning tool which may be used to initially tighten or finally loosen a threaded pipe section, particularly where convenient access to that pipe section lies intermediate the opposite ends thereof and from only one side of the pipe section.

Another object of this invention is to provide a pipe turning tool which may be conveniently used on oil well drilling rigs and also in other environments where similar pipe turning tasks are to be performed.

Yet another important object of this invention is to provide a pipe turning tool including a drive wheel therefore which may be driven by various power sources including, but not limited to, a spring drive, a reversable electric motor or a small combustion engine driving the drive wheel through a reversable transmission.

A final object of this invention to be specifically enumerated herein is to provide a pipe turning tool in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
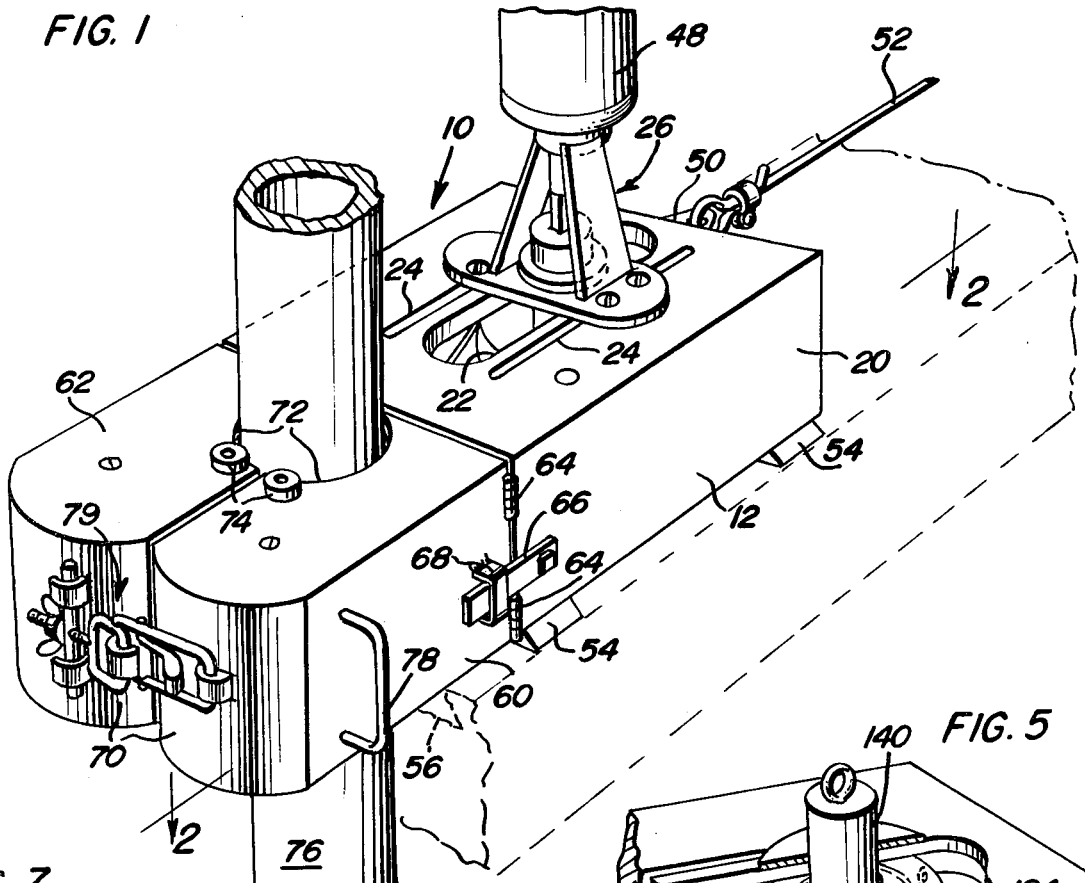
FIG. 1 is a perspective view of the tool operatively associated with a pipe section to be turned and with a supporting drilling rig thong illustrated in phantom lines.

Referring now more specifically to the drawings the numeral 10 generally designates a first form of pipe turning tool constructed in accordance with the present invention. The tool 10 includes a hollow body 12 having top and bottom walls 14 and 16 and opposite side walls 18 and 20. The body 12 may be tubular and open at its opposite ends. The top wall 14 of the body 12 includes central wide slot 22 formed therein and extending therealong as well as a pair of opposite side narrow slots 24 formed therein. A combined bearing journal and motor mount assembly referred to in general by the reference numeral 26 is supported on the top wall 12 for adjustable positioning therealong through the utilization of threaded fasteners 28 passing through the assembly 26 and the narrow slots 24. The bottom wall 16 has slots 30 and 32 formed therein corresponding to the slots 22 and 24 and a bearing assembly 36 is received in the slot 30, slideable longitudinally of the latter and securable in adjusted position through the utilization of fasteners 38 corresponding to the fasteners 28 passing through the slots 32. The assemblies 26 and 36 rotatably journal the upper and lower ends of a shaft 40 having a drive wheel 42 removably mounted thereon and the shaft 40 is upwardly axially displacebale from the bearing assemblies 26 and 36 and the drive wheel 42 for its removal, if desired. In addition, the upper end of the shaft 40 includes an upwardly opening noncircular socket 44 formed therein in which the lower end of an associated noncircular depending drive shaft 46 is received, the drive shaft 46 comprising the output shaft of a reversable electric motor 48. If desired, the reversable electric motor 48 may be substituted for by a low horse power combustion engine coupled to the input shaft of a reversing transmission whose output shaft may be engaged with the socket 44, or any other suitable drive means may be used.

The rear end of the top wall 14 includes an anchor lug 50 to which the free end of a snub line 52 is secured and the opposite side marginal portions of the bottom wall 16 include dovetailed projections 54 which may be slidingly received within a dovetailed groove 56 formed in the upper surface of oil well rig tongs 58 of otherwise conventional design. Further other suitable mounting structure on the tongs 58 may be used for supporting the tool 10 therefrom.

Figure 2:
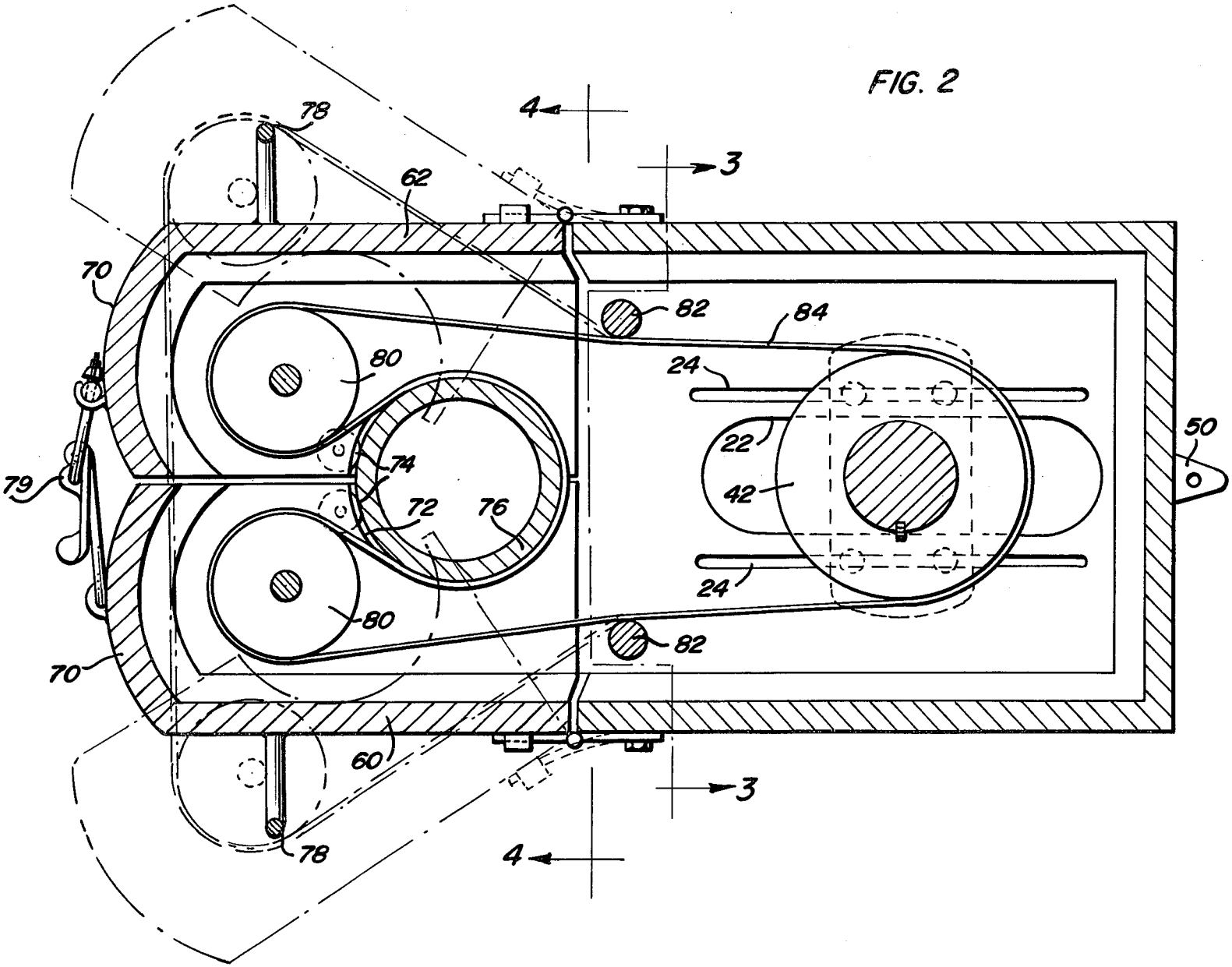
FIG. 2 is an enlarged horizontal sectional view taken substantially upon the plane indicated by the section line 2—2 of FIG. 1.
Figure 3:
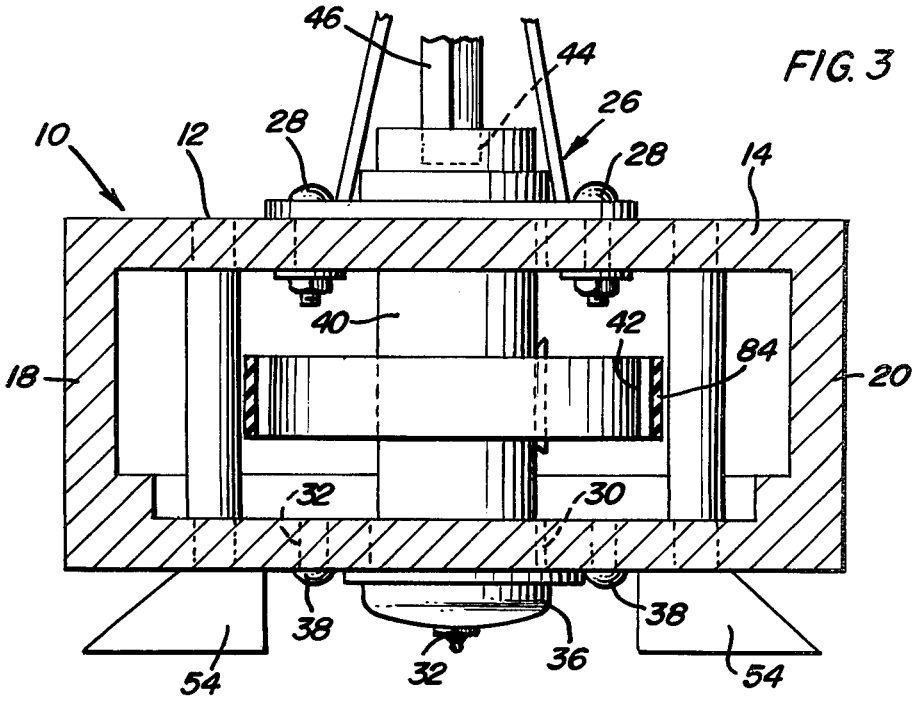
FIG. 3 is a vertical sectional view taken substantially upon the plane indicated by the section line 3—3 of FIG. 2.
Figure 4:
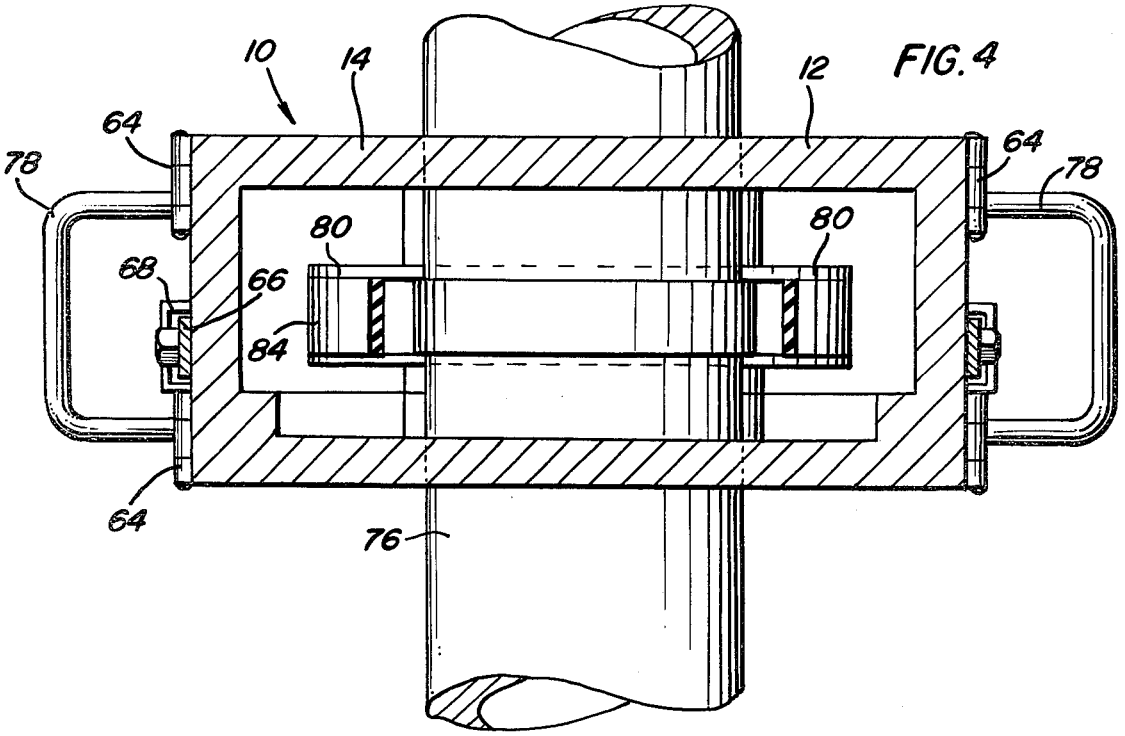
FIG. 4 is a vertical sectional view taken substantially upon the plane indicated by the section line 4—4 of FIG. 2.

The end of the body 12 remote from the anchor lug 50 has a pair of elongated arms 60 and 62 including base ends pivotally mounted to the body 12 through the utilization of hinges 64 whereby the arms are swingable between the closed solid line positions thereof illustrated in FIG. 2 and the open phantom line positions of FIG. 2. Base ends of a pair of leaf springs 66 are anchored to the side walls 18 and 20 of the body 12 and the leaf springs 66 include free ends slidably received through brackets 68 mounted on the corresponding sides of the arms 60 and 62, the springs 66 yieldingly biassing the arms 60 and 62 toward the closed positions thereof illustrated in solid lines in FIG. 2. The arms 60 and 62 are hollow and include closed outer ends 70 and have opposing semi-cylindrical recesses 72 formed in the upper and lower walls thereof adjacent the base ends. The forward or outer most extremities of the recesses 72 include upper and lower rollers 74 journalled from the arms 60 and 62 operatively associated therewith. The rollers 74 project slightly inwardly of the recesses 72 and rollingly engage the outer surfaces of a pipe section 76 disposed between the arms 60 and 62 when the latter are in their closed positions illustrated in solid lines in FIG. 2. In addition, the outer sides of the free ends of the arms 60 and 62 include handles 78 to be engaged by a workman to close the arms 60 and 62 about the pipe section 76. Still further, the closed free ends 70 of the arms 60 and 62 include adjustable over center latching structure referred to in general by the reference numeral 79 operatively associated therewith whereby the outer ends of the arms 60 and 62 may be adjustably latched against movement from the closed positions thereof to the open phantom line positions of the arms illustrated in FIG. 2.

The arms 60 and 62 have idle rollers 80 journalled therefrom for rotation about axes generally paralleling the shaft 40 and the body 12 has guide rollers 82 journalled therefrom which generally parallel the shaft 40.

An elongated toothed belt is trained about drive wheel 42 and the idle wheels or pulleys 80. When the arms 60 and 62 are in the open positions thereof illustrated in phantom lines in FIG. 2, the reach of the belt 84 extending between the sides of the wheels 80 remote from the wheel 42 is tensioned across the opening defined between the free ends of the arms 60 and 62. If the body 12 is then advanced toward the pipe section 76, the pipe section 76 engages and inwardly deflects the reach of the belt 84 extending between the wheels 80. Continued advancing of the body 12 toward the pipe section 76 causes further inward deflection of the reach of the belt 84 extending between the rollers 80 and the arms 60 and 62 to swing from the full open positions thereof illustrated in phantom lines in FIG. 2 of the drawings to the closed positions thereof illustrated in solid lines of FIG. 2 of the drawings. Final movement of the pipe section 76 inwardly toward the base ends of the arms 60 results in the belt 84 being tensioned about the pipe section 76 and the free ends of the arms 60 and 62 being swung toward their closed positions illustrated in solid lines in FIG. 2. Then, the latch structure or assembly 79 may be latched to prevent movement of the free ends of the arms 60 and 62 toward their open positions and the motor 48 may be operated to cause rotation of the drive wheel 42 and thus the belt 48 to impart rotary torque to the pipe section 76 in order to rotate the latter. Of course, the rollers 74 engage the pipe section 76 in order to maintain the belt 84 tensioned and the assemblies 26 and 36 may be shifted away from the arms 60 and 62 if the pipe section to be engaged by the belt 84 is smaller in diameter than the pipe section 76 to thus enable the belt or drive member 84 to be properly tensioned.

Figure 5:
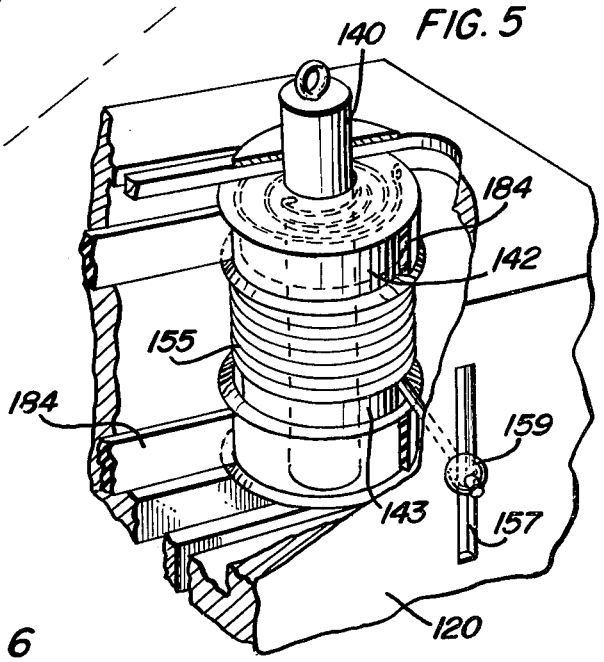
FIG. 5 is a fragmentary side elevational view of the tool.

If it is desired, the tool 10 need not be supported from the tongs 58. Instead, the tool 10 may be suspended by the suspension anchor 86 to which one end of a suspension cable 88 may be anchored, see FIG. 5.

Figure 6:
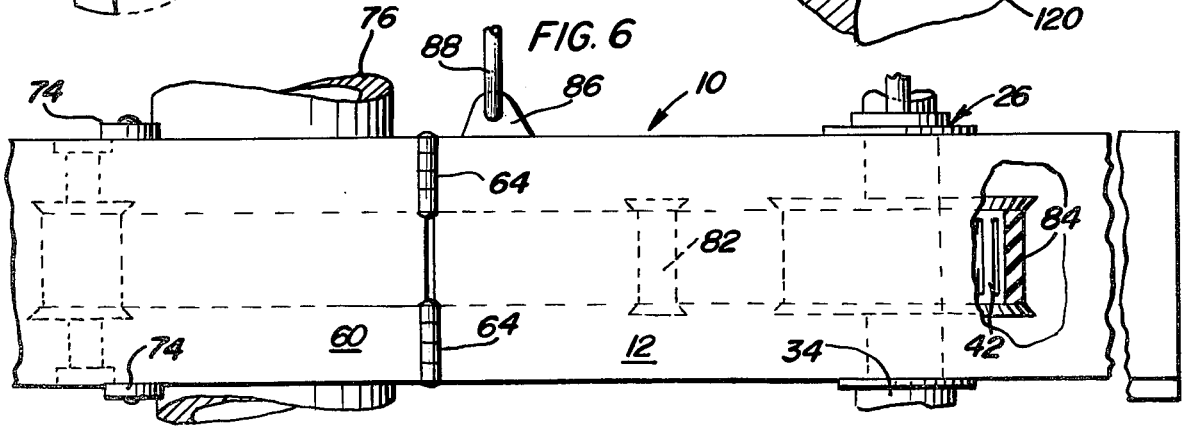
FIG. 6 is a fragmentary enlarged perspective view of a modified form of tool utilizing a spring driven drive wheel.

Referring now more specifically to FIG. 6 of the drawings, there may be seen a modified form of tool referred to in general by the reference numeral 110. The tool 110 is identical to the tool 10 in all respects, except for the drive wheel thereof. The drive wheel of the tool 110 corresponding to the drive wheel 42 comprises a drum 142 rotatable relative to a removable stationary shaft 140 corresponding to the shaft 40 and about whose opposite ends a pair of drive belts 184 are trained. The mid portion 143 of the drum 142 is rotatable relative to the latter and is connected thereto by a ratchet assembly (not shown) for driving engagement therewith in only one direction of rotation and one end of a pull cable 155 is secured to the mid portion 143 and wound thereon. The free end of the pull cable 155 passes through a slot 157 formed in the side wall 120 of the tool 110 and has an abuttment 159 mounted thereon. A coiled spring is connected between the mid portion 143 and the drum 142 and yielding biases the mid portion 143 in one direction which winds the cable 155 on the mid portion 143. In operation, the tool 110 may be engaged with a pipe section such as the pipe section 76 in the same manner in which the tool 10 is engaged with the pipe section 76 and the free end of the cable 155 projecting outwardly through the slot 157 may be pulled to turn the mid portion 143 and thus cause the pipe section with which the belts 184 are engaged to rotate. The pull on the cable 155 may be relaxed to allow the spring to rewind the cable 155 on the mid portion 143 and a pull may again be applied to the cable 155 to further rotate the pipe section 76. The shaft 140 may be shifted longitudinally of the body 112 of the tool 110 in substantially the same manner in which the shaft 40 may shifted longitudinally of the body 12 and if opposite rotation of the drum 142 is desired upon exertion of a pull on the cable 155, the shaft 140 is removed, the drum 142 is inverted and the shaft 140 is replaced. Of course, the tool 110 will include slightly longer rollers or wheels than the wheels 80 provide on the tool 10 in order to accomodate the two belts or drive members 184 as opposed to the single belt or drive member 84 provided on the tool 10.

It is also pointed out that the adjacent sides of the rollers or wheels 80, when the arms 60 and 62 are in the closed positions illustrated in FIG. 1, are spaced closer together than the diameter of the pipe section 76, thereby insuring that the belt 84 is in driving contact with the pipe section 76 throughout more than 180 degrees of its circumference.

Also, when the tool 10 is used in conjunction with conventional power tongs, the tool 10 may be used to apply all the necessary torque to rotate the pipe section 76 other than the greater torque to effect the initial lossening of the section 76 and final tightening of the latter.

Figure 7:
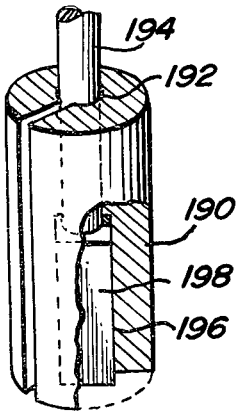
FIG. 7 is a perspective view of an adapter for use with the tool when a small diameter rod or the like is to be turned.

With attention now invited to FIG. 7 there may be seen a split sleeve adapter 190 constructed of rubber or similar material. The adapter 190 includes a smooth bore 192 extending therethrough for snugly receiving a small diameter rod 194 therethrough and the lower end of the sleeve adapter 190 is stiffened and reinforced by any suitable means and includes a square counterbore 196 for downward telescoping over the enlarged square cross sectional lower end of the rod 194. By using the adapted 190, the small diameter rod 194 may be turned by the tool 10.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A turning tool for laterally engaging an elongated member intermediate its opposite end and turning the elongated member about its longitudinal axis, said tool including a main body having a first side and a second side remote from the first side, said body being adapted to be shifted along a path extending between said sides toward and away from an elongated member to be engaged and turned and with said second side facing away from said elongated member, said first side including a pair of arms projecting outwardly therefrom, said arms including base end portions pivotally supported from said body for oscillation about first generally parallel axes and free end portions swingable toward and away from each other from opposite sides of said path, said free end portions including idle wheels journalled therefrom for rotation about second axes generally paralleling said first axes, a drive wheel journaled from said body and aligned with said idle wheels, drive means drivingly connected to said drive wheel for driving the latter, an elongated flexible drive member trained about said wheels and including a short reach thereof extending between the sides of said idle wheels remote from said drive wheel and adapted to be inwardly deflected by said elongated member to be turned upon movement of said body toward said elongated member when said free ends of said arms are swung away from each other to receive said elongated member inwardly between said idle rollers and between the latter and said drive wheel during movement of said free end portions of said arms toward each other, means operative to mount said body from a set of oil well rig tongs, said drive means including a drum removably and end-to-end reversibly journaled from said body and including first and second relatively rotatable portions, said first portion having a one-way drive connection with said second portion to rotate said second portion in a first direction responsive to rotation of said first portion in said first direction and enabling rotation of said first portion in the opposite direction relative to said second portion, spring means operatively connected between said first and second portions yieldingly biasing said first portion in said opposite direction relative to said second portion, said drive member being trained about said second portion, an elongated flexible tension member having one end portion thereof anchored to and wound upon said first portion and the other end portion of said tension member guidingly supported from said body and adapted to have intermittent pulling forces applied thereto, said tension member being wound upon said first portion in said opposite direction whereby a pull on said other end portion of said tension member will cause rotation of said first portion, and thus said second portion, in said first direction and a release of the pulling force on said other end portion of said tension member will allow said spring means to rotate said first portion in said opposite direction relative to said second portion to rewind said tension member on said first portion.

2. The tool of claim 1 including latch means operatively associated with said arms for releasably latching the free end portions thereof against swinging movement away from each other.

3. The tool of claim 2 wherein said latch means includes means operative to adjustably limit movement of said free end portions of said arms away from each other.

4. The tool of claim 1 including means operative to adjustably shift the axis of rotation of said drive wheel along a path generally paralleling the first mentioned path relative to said body.

5. The tool of claim 1 including means operatively associated with said arms yielding biasing the latter toward closed position with said free end portions swung toward each other.

6. The tool of claim 1 including a longitudinally split sleeve adapter for disposition about a small diameter rod, one end of said sleeve adapter including a non-circular cross sectional counterbore for telescopingly receiving therein an enlarged non-circular cross section end on said small diameter rod therein.

7. A turning tool for laterally engaging an elongated member intermediate its opposite ends and turning the elongated member about its longitudinal axis, said tool including a main body having a first side and a second side remote from the first side, said body being adapted to be shifted along a path extending between said sides toward and away from an elongated member to be engaged and turned and with said second side facing away from said elongated member, said first side including a pair of arms projecting outwardly therefrom, said arms including base end portions pivotally supported from said body for oscillation about first generally parallel axes and free end portions swingable toward and away from each other from opposite sides of said path, said free end portions including idle wheels journalled therefrom for rotation about second axes generally paralleling said first axes, a drive wheel journaled from said body and aligned with said idle wheels, drive means drivingly connected to said drive wheel for driving the latter, an elongated flexible drive member trained about said wheels and including a short reach thereof extending between the sides of said idle wheels remote from said drive wheel and adapted to be inwardly deflected by said elongated members to be turned upon movement of said body toward said elongated member when said free ends of said arms are swung away from each other to receive said elongated member inwardly between said idle rollers and between the latter and said drive wheel during movement of said free end portions of said arms toward each other, guide rollers disposed on oposite sides of said pathand inwardly deflecting the mid portions of long reaches of said drive member extending between said drive wheel and the remote peripheral portions of said idle wheels, said guide rollers comprising the sole guide structures engaging said long reaches.

* * * * *